US011905575B2

(12) United States Patent
Sun et al.

(10) Patent No.: US 11,905,575 B2
(45) Date of Patent: Feb. 20, 2024

(54) METHOD FOR PROCESSING TITANIUM EXTRACTION SLAG AND CARBON EXTRACTED AND DECHLORINATED TAILING

(71) Applicant: SOUTHWEST UNIVERSITY OF SCIENCE AND TECHNOLOGY, Mianyang (CN)

(72) Inventors: Hongjuan Sun, Mianyang (CN); Tongjiang Peng, Mianyang (CN); Hao You, Mianyang (CN); Wenjin Ding, Mianyang (CN); Liming Luo, Mianyang (CN); Bo Liu, Mianyang (CN)

(73) Assignee: SOUTHWEST UNIVERSITY OF SCIENCE AND TECHNOLOGY, Mianyang (CN)

( * ) Notice: Subject to any disclaimer, the term of this patent is extended or adjusted under 35 U.S.C. 154(b) by 254 days.

(21) Appl. No.: 17/529,834

(22) Filed: Nov. 18, 2021

(65) Prior Publication Data

US 2022/0170132 A1 Jun. 2, 2022

(30) Foreign Application Priority Data

Nov. 27, 2020 (CN) ..... 202011361918.0
Mar. 10, 2021 (CN) ..... 202110259702.1

(51) Int. Cl.
*C22B 7/04* (2006.01)
*C22B 7/00* (2006.01)
*C22B 34/12* (2006.01)

(52) U.S. Cl.
CPC ..... *C22B 7/04* (2013.01); *C22B 7/006* (2013.01); *C22B 34/1209* (2013.01); *C22B 34/1259* (2013.01)

(58) Field of Classification Search
CPC ..... C22B 7/04; C22B 7/006; C22B 34/1209
See application file for complete search history.

(56) References Cited

FOREIGN PATENT DOCUMENTS

CN 104841563 A * 8/2015

OTHER PUBLICATIONS

Berger "Ore Optional Semi-Industrial Testing" Oct. 30, 1986, img.duxiu.com and jingjilei.cn.

* cited by examiner

*Primary Examiner* — Shuangyi Abu Ali
(74) *Attorney, Agent, or Firm* — WPAT, P.C.

(57) ABSTRACT

Provided are a method for processing titanium extraction slag and a carbon extraction and dechlorination tailing. The method comprises the following steps that a titanium extraction slag raw material is ground to obtain a treated material with a particle size being 0.3~120 μm and $d_{90}$≤90 μm; a first solvent and a treated material are mixed with a liquid-solid ratio of (3.5~4.5): 1 L/kg, and a first capturing agent and a first foaming agent are added for mixing and then subjected to a primary flotation to obtain a floating product and a sinking product; and a second solvent is added into the floating product to adjust the liquid-solid ratio to (4~5): 1 L/kg, a second capturing agent and a second foaming agent are added for mixing and then subjected to a secondary flotation to obtain a foam product; the foam product is filtered and dried to obtain a refined carbon, and the sinking product is filtered and dried to obtain the carbon extraction and dechlorination tailing, wherein the $d_{90}$≤90 μm means that more than 90% of the powder in the treated material has a particle size of less than 90 μm. The method has the advantages that carbon in the titanium-extracted slag can be recycled, chlorine is removed, and the carbon extraction and dechlorination tailing can be used as a building material raw material.

12 Claims, 6 Drawing Sheets

METHOD FOR PROCESSING TITANIUM EXTRACTION SLAG AND CARBON EXTRACTED AND DECHLORINATED TAILING

CROSS-REFERENCE TO RELATED APPLICATION

The present application claims priorities from China Patent Applications No. 202011361918.0 and 202110259702.1, filed on Nov. 27, 2020 and Mar. 10, 2021 respectively, in the State Intellectual Property Office of P. R. China, the disclosures of which are incorporated herein in its entirety by reference.

TECHNICAL FIELD

The disclosure relates to a field of resource utilization and harmless treatment of industrial solid waste, and particularly relates to a method for processing titanium extraction slag, a carbon extraction and dechlorination tailing prepared by the method, and an environmentally friendly carbonaceous additive for casting green sand.

BACKGROUND

Titanium extraction slag (i.e., Tailing after extraction of titanium) is a secondary waste slag obtained from titanium containing blast furnace slag after undergoing the treatment of 'high-temperature carbonization and low-temperature selective chlorination'. The 'high-temperature carbonization and low-temperature selective chlorination' process for extracting titanium is to react high-titanium blast furnace slag (i.e., $TiO_2$ content of 22%-25%) with carbon at high temperature (i.e., about 1450-1600° C.), so as to make the $TiO_2$ contained in the high-titanium blast furnace slag form TiC, and then chlorine gas is introduced at low temperature (i.e., about 450-550° C.) to react, so that the previously formed TiC is converted into gas phase $TiCl_4$. Affected by the process of the high-temperature carbonization, about 5~10% of the carbon does not participate in the carbonization reaction, and remains in the titanium extraction slag in the form of graphite-like carbon (GLC). If it is not recycled, it will cause waste of carbon resources. In addition, affected by the process of the low-temperature chlorination, the titanium extraction slag contains about 2 to 5% of chlorine, and the higher content of chlorine makes it impossible to directly utilize the titanium extraction slag as a raw material for building materials. Therefore, it is necessary to recover the graphite-like carbon in the titanium extraction slag and reduce the chlorine content of the titanium extraction slag.

Carbon additives are an important part of casting green sand. Its function is to prevent the surface of castings from sticking to sand and generate pores, and to make the surface of castings smooth. In traditional green sand casting, pulverized coal is generally added to improve the quality of the casting. However, pulverized coal has the following shortcomings:

(1) Because pulverized coal is processed from industrial coal, and industrial coal is a very important energy material, and the requirements for pulverized coal are relatively high, it must be high-quality coal. If pulverized coal continues to be used in large quantities, it will cause a lot of waste of energy;

(2) The bright carbon generation rate of pulverized coal is low. In order to obtain high-quality castings in casting production, a large amount of pulverized coal needs to be added, which will reduce the permeability of the casting green sand and affect the process and castings;

(3) Generally, the composition of pulverized coal for foundry is complicated. When casting at high temperature, pulverized coal will thermally interpret a large amount of toxic and harmful gases, causing serious pollution to the human body and the environment.

Therefore, there is an urgent need to develop carbon additives with excellent performance and environmental friendliness.

SUMMARY

In view of the deficiencies in the related art, the objects of the present disclosure are to solve one or more problems in the related art. For example, one of the objects of the present disclosure is to provide a method capable of simultaneously removing graphite-like carbon and chlorine in titanium extraction slag. Another object of the present disclosure is to provide a carbon extraction and dechlorination tailing with low chlorine content and which can be directly used as building materials.

In order to achieve the above objective, one aspect of the present disclosure provides a method for processing titanium extraction slag, wherein the method comprising a carbon extraction and dechlorination process. The method includes the steps of grinding the titanium extraction slag raw material to obtain a treated material with a particle size of 0.3~120 μm and $d_{90} \leq 90$ μm;

Mixing a first solvent and the treatment material with a liquid-to-solid ratio of 3.5~4.5:1 L/kg, additionally adding a first capturing agent and a first foaming agent to mix, and then performing a primary flotation to obtain a floating product and a sinking product;

Adding a second solvent to the floating product to adjust the liquid-to-solid ratio to 4~5:1 L/kg, additionally adding a second capturing agent and a second foaming agent to mix, and then performing a secondary flotation to obtain a foam product; filtering and drying the foamed product to obtain a refined carbon, and filtering and drying the sinking product to obtain a carbon extraction and dechlorination tailing; wherein, the $d_{90} \leq 90$ μm means that more than 90% of the powder in the treated material has a particle size of less than 90 μm.

In an exemplary embodiment of an aspect of the present disclosure, after filtering the sinking product, a first filtrate is also obtained; the method may further include a step of returning the first filtrate to be used as the first solvent.

In an exemplary embodiment of an aspect of the present disclosure, after the secondary flotation is performed, a bottom tank product is also obtained; the method may further include: steps of filtering and drying the bottom tank product to obtain a filter residue and a second filtrate, and returning the second filtrate to be used as the second solvent.

In an exemplary embodiment of an aspect of the present disclosure, the method may further include a step of returning the filter residue to be used as the treated material.

In an exemplary embodiment of an aspect of the present disclosure, both of the primary flotation and the secondary flotation may be realized by a flotation machine, wherein, during the primary flotation, the stirring rate of the flotation machine is 1300~1500 r/min, the aeration amount is 0.3~0.35 $m^3$/min, and the flotation time is 2~4 min; during the secondary flotation, the stirring rate of the flotation machine is 1500 to 1800 r/min, the aeration amount is 0.3 to 0.35 $m^3$/min, and the flotation time is 6 to 9 min.

In an exemplary embodiment of an aspect of the present disclosure, both the first capturing agent and the second capturing agent may both include at least one of kerosene and diesel, and the first foaming agent and the second foaming agent may both include at least one of second oil and secondary octanol.

In an exemplary embodiment of an aspect of the present disclosure, the amount of the first capturing agent may be 0.5~2.5 kg/t titanium extraction slag, and the amount of the first foaming agent may be 0.5~2.5 kg/t titanium extraction slag, the amount of the second capturing agent may be 0.5~1.0 kg/t titanium extraction slag, and the amount of the second foaming agent may be 0.5~1.0 kg/t titanium extraction slag.

In an exemplary embodiment of one aspect of the present disclosure, the removal rate of carbon in the titanium extraction slag may be 50~90%, and the removal rate of chlorine may be 97~98.5%.

In an exemplary embodiment of one aspect of the present disclosure, wherein the method may further comprise: using a microcrystalline graphite, an extract of the titanium extraction slag and coal gasification slag as main raw materials, mixing to obtain an environmentally friendly carbonaceous additive for casting green sand, the extract of the titanium extraction slag is the refined carbon.

In an exemplary embodiment of one aspect of the present disclosure, the method may comprise: grinding the raw materials contained the microcrystalline graphite, the extract of the titanium extraction slag and the coal gasification slag to obtain a powder with a particle size of <75 μm; uniformly mixing the microcrystalline graphite, the extract of the titanium extraction slag and the coal gasification slag powder in a mass ratio of 60-80:0-20:0-20 to obtain the environmentally friendly carbonaceous additive.

In an exemplary embodiment of one aspect of the present disclosure, wherein the fixed carbon content of the environmentally friendly carbonaceous additive may be 65-83% by mass, and the fixed carbon of the microcrystalline graphite may be 78-83% by mass, the fixed carbon of the titanium extraction slag extract may be 45-55% by mass, and the fixed carbon of the coal gasification slag may be 6-15% by mass.

In an exemplary embodiment of one aspect of the present disclosure, wherein the graphite phase carbon content of the microcrystalline graphite may be 98-100% by mass; both of the extract of the titanium extraction slag and the coal gasification slag may include a crystalline phase and an amorphous phase, the crystalline phase in the titanium extraction slag may be 75-85% by mass, and the crystalline phase in the coal gasification slag may be 15~25% by mass.

In an exemplary embodiment of one aspect of the present disclosure, a mineral phase in the environmentally friendly carbonaceous additive may include a crystalline phase and an amorphous phase, and the mass percentage content of the crystalline phase may be 85-92%, the mass percentage content of the amorphous phase may be 8-15%, wherein the main crystalline phase may be graphite phase carbon, and the secondary crystalline phase may include graphite-like phase carbon.

In an exemplary embodiment of one aspect of the present disclosure, wherein the microcrystalline graphite may contain graphite phase carbon, the graphitization degree thereof may be 93-98%; and the extract of the titanium extraction slag may contain graphite-like phase carbon, the graphitization-like degree thereof may be 38-53%; the coal gasification slag may contain graphite-like phase carbon, and the graphitization-like degree thereof may be 47-52%.

In an exemplary embodiment of one aspect of the present disclosure, wherein the raw materials further may include one or more of flake graphite, fly ash, 'carbon' in fly ash and other carbon-rich materials.

In an exemplary embodiment of one aspect of the present disclosure, wherein the method may further comprise: preparing green casting sand with 100 parts by mass of quartz sand, 8-10 parts by mass of sodium bentonite, and 3-7 parts by mass of the environmentally friendly carbonaceous additive.

In an exemplary embodiment of one aspect of the present disclosure, wherein the step of preparing green casting sand may include: sending 100 parts by mass of quartz sand, 8-10 parts by mass of sodium bentonite, and 3-7 parts by mass of environmentally friendly carbonaceous additive into the sand mixer to mix, and using the hammer type sample preparation machine to make 50 mm±1% cylindrical samples and 30 mm±1% strip sample, wherein the sample compaction rate is controlled to 45±2%.

Another aspect of the present disclosure provides a tailing for carbon extraction and dechlorination. The carbon extraction and dechlorination tailing is prepared by the above mentioned method, and the carbon extraction and dechlorination tailing includes 30-32% CaO, 27~28% $SiO_2$, 13~15% $Al_2O_3$, 12~14% $TiO_2$, 7~8% MgO, 2~2.5% $Fe_2O_3$, 0.34~2.1% C, 0.04~0.06% Cl by mass fraction.

In an exemplary embodiment of another aspect of the present disclosure, the ignition loss of the carbon extraction and dechlorination tailing may be 0.4~2.5%, the crystalline phase may be titanium carbide, and the crystallinity may be 10~12%.

Another aspect of the present disclosure provides an environmentally friendly carbonaceous additive, wherein the environmentally friendly additive includes microcrystalline graphite, extract of the titanium extraction slag and coal gasification slag, wherein the microcrystalline graphite accounts for 60 to 80% by mass percentage, the extract of the titanium extraction slag accounts for 0-20% by mass percentage, and the coal gasification slag accounts for 0-20% by mass percentage, the extract of the titanium extraction slag is obtained by flotation of the titanium extraction slag by the above mentioned method.

Another aspect of the present disclosure provides an casting green sand, wherein the casting green sand includes 100 parts by mass of quartz sand, 8-10 parts by mass of sodium bentonite, and 3-7 parts by mass of the environmentally friendly carbonaceous additive according to claim 19, and a particle size of the quartz sand is 70-140 mesh.

Compared with the related art, the beneficial effects of the present disclosure may include:

(1) Effective recovery of graphite-like carbon in the titanium extraction slag; efficient removal of chlorine in the titanium extraction slag; the obtained refined carbon having a higher ignition loss of but lower chlorine content, which can be as an industrial fuel; the obtained tailing have low ignition loss and chlorine content, and can be used as raw materials for building materials.

(2) The raw materials of preparing the environmentally friendly carbonaceous additive of the present disclosure includes the extract of the titanium extraction slag and the coal gasification slag, which can realize waste recycling and low cost.

(3) The total amount of gas released by the environmentally friendly carbonaceous additive for casting green sand of the present disclosure at high temperatures is only about 10% of that of pulverized coal. Wherein, the harmful gas contains only a small amount of benzene, substituted benzene and polycyclic aromatic hydrocarbons (PAHs), and does not contain acenaphthylene, fluorene, anthracene and phenols, etc., and the environmental hazards are significantly reduced.

(4) The environmentally friendly carbonaceous additive for casting green sand of the present disclosure has a low thermal expansion rate, can effectively improve the quality of the casting, and prevent the deformation of the casting.

(5) The environmentally friendly carbonaceous additive for casting green sand of the present disclosure can significantly improve the binding force between the binder and the quartz sand, and improve the wet compression strength.

BRIEF DESCRIPTION OF DRAWINGS

The above and other objectives and features of the present disclosure will become clearer through the following description in conjunction with the accompanying drawings, in which.

DETAILED DESCRIPTION

Hereinafter, the method for carbon extraction and dechlorination of titanium extraction slag and the carbon extraction and dechlorination tailing of the present disclosure will be described in detail with reference to the accompanying drawings and exemplary embodiments.

Titanium extraction slag is a secondary industrial waste slag obtained from titanium-containing blast furnace slag after undergoing the process of 'high-temperature carbonization and low-temperature selective chlorination' to extract titanium. The main components of the titanium extraction slag are CaO, $SiO_2$, and $Al_2O_3$. Affected by the process of 'high-temperature carbonization-low-temperature selective chlorination', the titanium extraction slag contains about 5~10% carbon and 2~5% chlorine. The higher carbon content and chlorine content make the titanium extraction slag unable to be directly used as building materials. Therefore, it is necessary to perform a treatment of carbon reduction and dechlorination for the titanium extraction slag. According to the principle of foam flotation, the disclosure utilizes the different hydrophobicity of minerals of different components, increases the hydrophobicity of the minerals containing the titanium extraction slag by adding agents, and floats to the surface of the aqueous solution in the form of foam, so that the carbon-containing minerals contained in the titanium extraction slag can be recovered. At the same time, during the flotation process, the impeller agitation promotes the titanium extraction slag to fully contact with water, and the soluble chloride salt and free chlorine in the titanium extraction slag will dissolve in the water, thereby reducing the chlorine content of the titanium extraction slag and achieving the purpose of dechlorination.

An aspect of the present disclosure provides a method for processing titanium extraction slag. The processing method comprises a carbon extraction and dechlorination process of titanium extraction slag.

Figure 1:
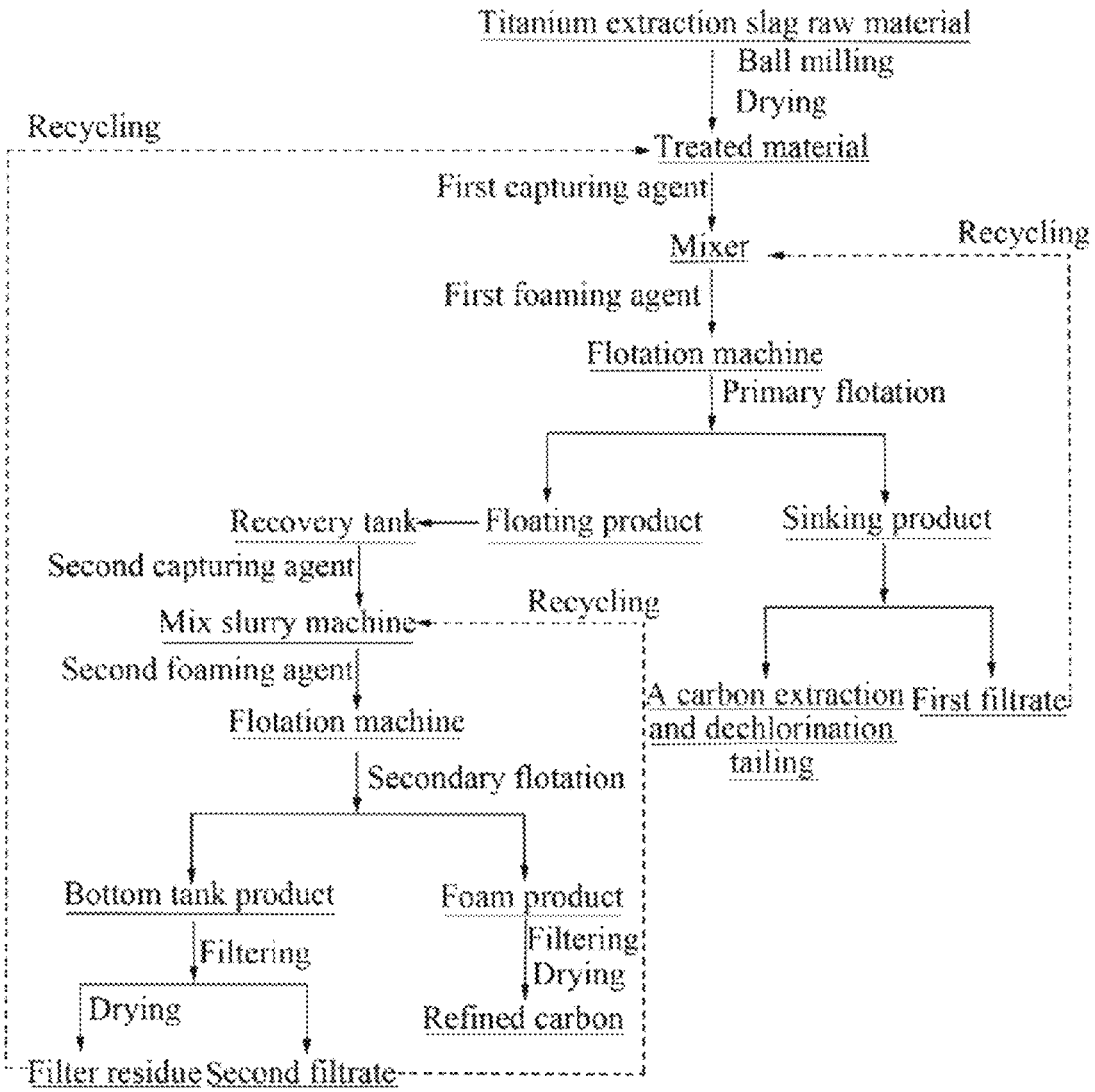
FIG. 1 is a schematic flow chart showing an exemplary embodiment of the method for carbon extraction and dechlorination of the titanium extraction slag according to the present disclosure.

FIG. 1 is a schematic flow chart showing an exemplary embodiment of the method (process) for carbon extraction and dechlorination of the titanium extraction slag according to the present disclosure.

Figure 2:
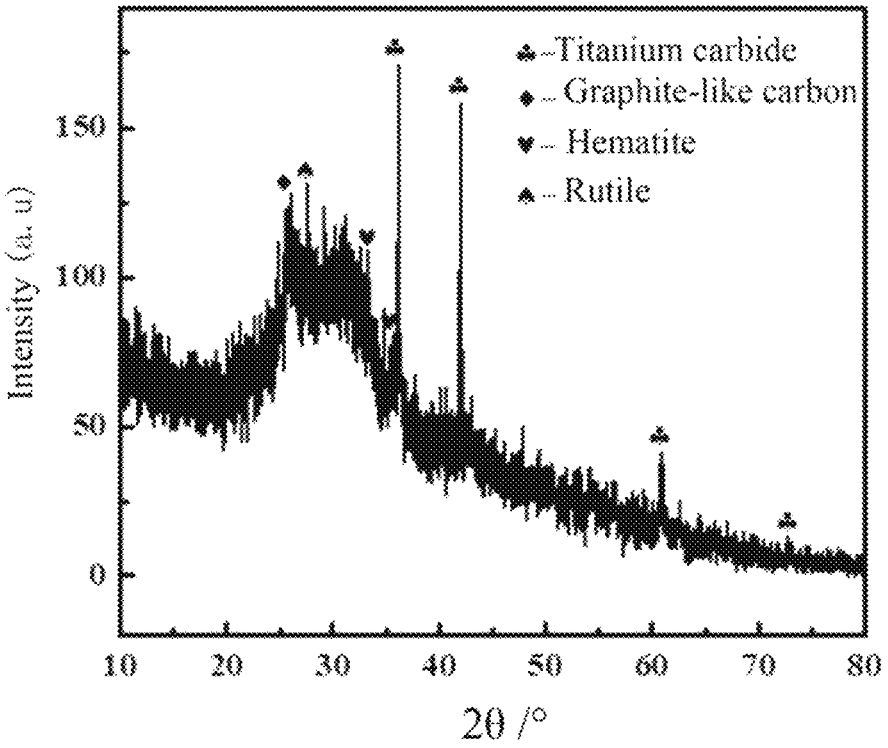
FIG. 2 shows an X-ray diffraction diagram of a raw material of the titanium extraction slag in an exemplary embodiment of the method for carbon extraction and dechlorination of the titanium extraction slag according to the present disclosure.

In an exemplary embodiment of the present disclosure, as shown in FIG. 1, the method for carbon extraction and dechlorination of titanium extraction slag may include the following steps:

Raw material pretreatment: grind the titanium extraction slag raw material to obtain a treated material with a particle size of 0.3~120 μm and $d_{90} \leq 90$ μm. Wherein, the $d_{90} \leq 90$ μm means that more than 90% of the powder in the treatment material has a particle size of less than 90 μm. Specifically, the carbon content in the titanium extraction slag raw material is about 5~10%, the chlorine content is about 2.5~5.5%, and the moisture content is about 2~7%. Before the grinding step, the titanium extraction slag raw material is dried at 150~250° C. or 60~120 minutes, and after drying treatment, the moisture content of the titanium extraction slag raw material is reduced to 0.5~1%. The grinding method is selected as ball milling, and then the titanium extraction slag raw material is extracted by ball milling according to the mass ratio of grinding balls and the titanium extraction slag at 1~2:1 kg/kg, rotating speed at 180~220 r/min, and ball milling time at 60~90 min, so as to obtain the treatment material with a particle size of 0.3~120 μm and $d_{90} < 90$ μm. Here, the grinding balls may be zirconia ceramic balls, alumina ceramic balls or agate. Since the grinding balls are usually harder and will not be easily damaged, the quality of the treated material after grinding is equal to the amount of the titanium extraction slag raw material. As shown in FIG. 2, the phase composition of the titanium extraction slag raw material includes a crystalline phase and an amorphous phase. The crystalline phase of the titanium extraction slag is graphite-like carbon, titanium carbide, hematite and rutile. Wherein the titanium carbide is the main crystalline phase. Calculated by Jade, the crystallinity of the titanium extraction slag raw material is about 25~35%.

Primary mixing and primary flotation: a first solvent and the treatment material are mixed with a liquid-to-solid mixing ratio of 3.5~4.5:1 L/kg, a first capturing agent and a first foaming agent are further added therein to mix, and then the primary flotation is performed, so as to prepare a floating product and a sinking product. The first solvent may be water, but the present disclosure is not limited thereto, and other solvents with the same function may also be used. Here, the amount of the first capturing agent may be 0.5~2.5 kg/t of the titanium extraction slag, and the amount of the first foaming agent may be 0.5~2.5 kg/t titanium extraction slag. For example, the mass ratio of the first capturing agent to the titanium extraction slag is 0.5 to 2.5: 1000, or 0.5 to 2.5 kg of the first capturing agent is used for per ton of the titanium extraction slag; the mass ratio of the first foaming agent to the titanium extraction slag 0.5~2.5:1000, or 0.5~2.5 kg of the first foaming agent is used for per ton of titanium extraction slag. Here, the primary flotation is realized by a flotation machine. During the primary flotation, the stirring rate of the flotation machine may be 1300~1500 r/min, the aeration amount may be 0.3~0.35 $m^3$/min, and the flotation time may be 2~4 min. Specifically, as shown in FIG. 1, the treated material is placed in a mixer, and the water is added therein to adjust the liquid-to-solid ratio to 3.5~4.5:1 L/kg, and then 0.5~2.5 kg/t titanium extraction slag of the first capturing agent is added, mixed and stirred evenly, and transferred into the flotation machine. The stirring rate of the flotation machine during the primary flotation is controlled at 1300~1500 r/min, and the aeration rate is controlled at 0.3~0.35 $m^3$/min, then 0.5~2.5 kg/t titanium extraction slag of the first foaming agent is added, and the floatation is carried out for 2 to 4 minutes. During the flotation process, the scraper is turned on to sweep the floating product into the recovery tank. After the primary flotation, the sinking product is filtered, dried and dehydrated to form a carbon carbon extraction and dechlorination tailing. Here, the first capturing agent may include at least one of kerosene and diesel. The first foaming agent may include at least one of a second oil (No. 2 oil) and secondary octanol (2-Octanol).

Figure 3:
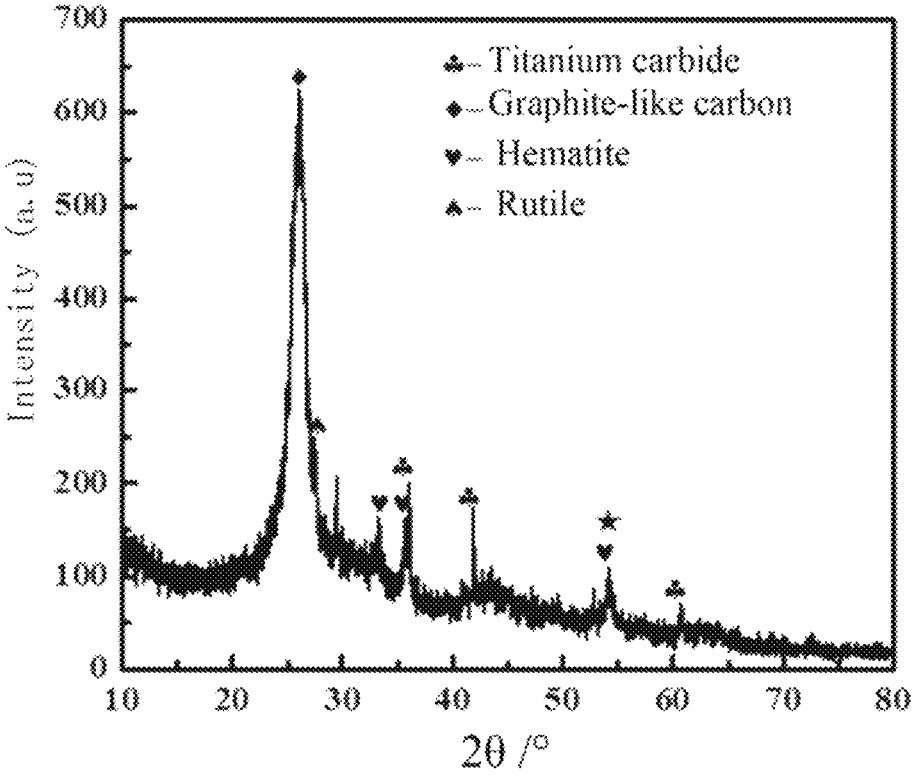
FIG. 3 shows an X-ray diffraction diagram of the refined carbon of Example 1.

Secondary mixing and secondary flotation: a second solvent is added to the floating product to adjust the liquid-solid ratio to 4-5:1 L/kg to mix, a second capturing agent and a second foaming agent are further added therein to mix, and then a secondary flotation is performed, so as to obtain a foam product. The second solvent may be water, but the present disclosure is not limited thereto, and other solvents with the same function may also be used. Here, the secondary flotation may be realized by a flotation machine. The stirring rate of the flotation machine during the secondary flotation may be 1500~1800 r/min, the aeration amount may be 0.3~0.35 $m^3$/min, and the flotation time may be 6~9 min. Here, the amount of the second capturing agent may be 0.5~1.0 kg/t titanium extraction slag, and the amount of the second foaming agent may be 0.5~1.0 kg/t titanium extraction slag. For example, the mass ratio of the second capturing agent to the titanium extraction slag is 0.5~1.0:1000, or 0.5~1.0 kg of the second capturing agent is used per ton of the titanium extraction slag; the mass ratio of the second foaming agent and the titanium extraction slag is 0.5~1.0:1000, or 0.5~1.0 kg of the second foaming agent is used per ton of titanium extraction slag. Specifically, as shown in FIG. 1, the floating product in a recovery tank is transported to a mix slurry machine, and water is firstly added to adjust the liquid-to-solid ratio to 4~5:1 L/kg, and then 0.5~1.0 kg/t titanium extraction slag of the second capturing agent is added and transferred to the flotation machine after being evenly mixed. The stirring rate of the flotation machine is controlled at 1500~1800 r/min, the aeration rate thereof is controlled at 0.3—0.35 $m^3$/min, and then 0.5~1.0 kg/t titanium extraction slag of second foaming agent is further added, flotation for 6~9 min. During the flotation process, the scraper is turned on to sweep and recover the foam product that floats to the liquid surface. After the foam product is filtered, dried and dehydrated, refined carbon containing graphite-like carbon is obtained. A product that sinks to the bottom of the tank (a bottom tank product) of the flotation machine after the secondary flotation is filtered, dried and dehydrated, and then used as a treated material to re-carry out carbon extraction treatment. The filtrate produced in the filtration process of the bottom tank product is returned to the mix slurry machine for reuse. FIG. 3 shows an X-ray diffraction diagram of the refined carbon of Example 1. As shown in FIG. 3, the phase composition of the refined carbon includes a crystalline phase and an amorphous phase. The crystalline phases of refined carbon are graphite-like carbon, titanium carbide, hematite and rutile. Wherein, Graphite-like carbon is the main crystalline phase, and the degree thereof is 75-85%. Here, the above-mentioned primary flotation and secondary flotation are only used to distinguish each other, and do not indicate the number of flotation.

Figure 4:
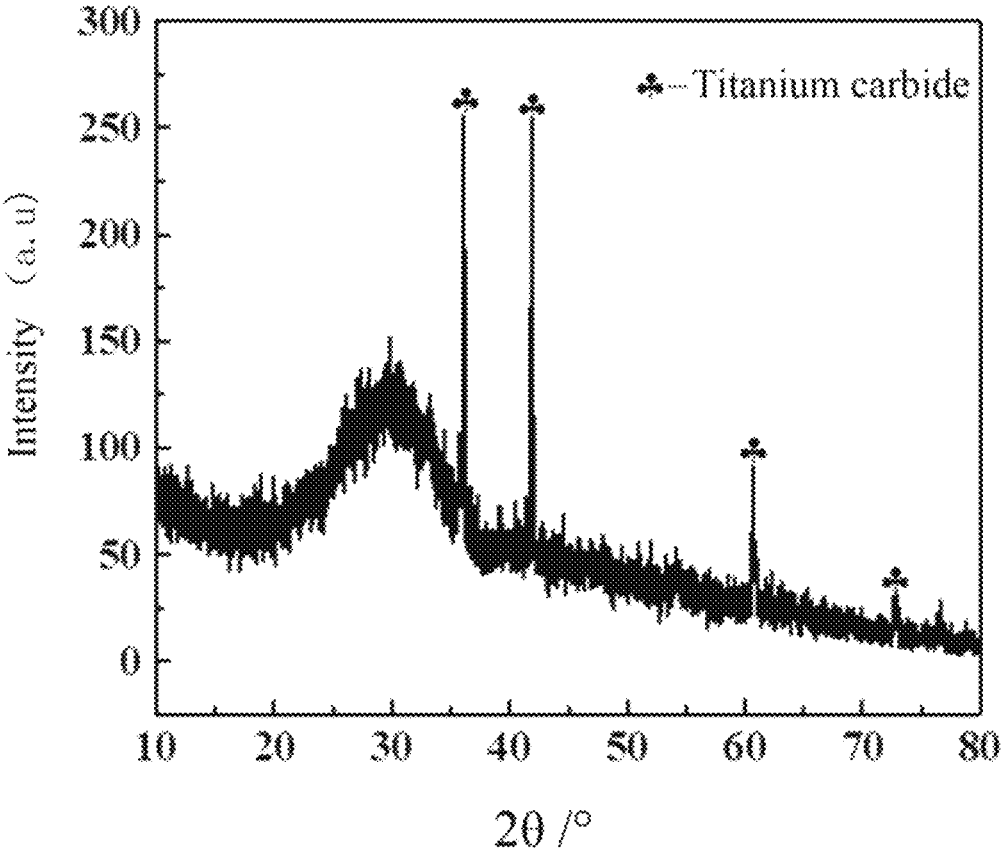
FIG. 4 shows an X-ray diffraction diagram of the extraction and dechlorination tailing of Example 1.

Preparation of the refined carbon and a carbon extraction and dechlorination tailing: the foam product is filtered and dried to obtain the refined carbon. The sinking product is filtered and dried to obtain the carbon extraction and dechlorination tailing. Specifically, as shown in FIG. 1, during the primary flotation process, the sinking product after the flotation is filtered, dried and dehydrated to form the carbon extraction and dechlorination tailing. The tailing of carbon extraction and dechlorination has low ignition loss and extremely low chlorine content. After testing, the ignition loss of the carbon extraction and dechlorination tailing is about 0.4~2.5%, the chlorine content is about 0.04~0.06%, and the dechlorination efficiency is 97~98.5%. As shown in FIG. 4, the phase composition of the carbon extraction and dechlorination tailing includes a crystalline phase and an amorphous phase. The crystalline phase of the carbon extraction and dechlorination tailing is only titanium carbide. The crystallinity of the sample calculated by Jade is 10~12%. During the secondary flotation process, the scraper of the flotation machine is turned on to scrape and recover the foam product that has floated to the liquid surface. After filtration, drying and dehydration, the refined carbon containing graphite-like carbon may be obtained. The obtained refined carbon is graphite-like carbon, and the refined carbon has a relatively high ignition loss. The ignition loss of refined carbon is 46~60%, and the chlorine content is 0.02~0.03%. As shown in FIG. 3, the crystalline phase of the refined carbon is graphite-like carbon, titanium carbide, hematite and rutile. The crystallinity of the refined carbon is 75~85%. The crystallinity of the sample is calculated by Jade.

In this exemplary embodiment, as shown in FIG. 1, on the basis of the above mentioned exemplary embodiment, the method may further include: after filtering the sinking product, a first filtrate is also obtained; the method may further include the step of returning the first filtrate to be used as the first solvent. Specifically, the first filtrate generated during the filtering process of the sinking product may be returned to the mixer as the first solvent for recycling. Here, after multiple cycles of the first filtrate (for example, 5 to 8 cycles), the dissolved chlorine content therein is relatively high. After evaporation, concentration and crystallization, a chloride powder (e.g. calcium chloride and magnesium chloride) may be obtained. By recycling the first filtrate, the amount of the first solvent may be saved and pollution emissions may be reduced.

In this exemplary embodiment, as shown in FIG. 1, on the basis of the above mentioned exemplary embodiment, the method may further include: after the secondary flotation is performed, the bottom tank product is also obtained; and the method may further include: filtering and drying the bottom tank product to obtain a filter residue and a second filtrate; and returning the second filtrate to be used as the second solvent. Specifically, the second filtrate produced in the filtration process of the bottom tank product may be returned to the mix slurry machine as the second solvent for recycling. Here, after multiple cycles of the second filtrate (for example, 20 to 30 cycles), the dissolved chlorine content in the second filtrate is relatively high. After evaporation, concentration and crystallization, the chloride powder (e.g. calcium chloride and magnesium chloride) may be obtained. By recycling the second filtrate, the amount of the second solvent may be saved and pollution emissions may be reduced.

In this exemplary embodiment, as shown in FIG. 1, the method may further include a step of returning the filter residue to be used as the treatment material on the basis of the above exemplary embodiment. Specifically, the filter residue generated after the bottom tank product is filtered and dried may be recycled as a treatment material to reduce the discharge of the filter residue and improve the carbon recovery efficiency.

In this exemplary embodiment, the removal rate of carbon in the titanium extraction slag may be 50~90%, and the removal rate of chlorine may be 97~98.5%. Here, the removal rate of carbon in the titanium extraction slag may be calculated by formula (1), and the removal rate of chlorine may be calculated by formula (2).

The formula (1) is:

$$\varphi=(M_1-M_2)/M_1\times 100\%$$

Wherein, φ is the removal rate of carbon in the titanium extraction slag, %; $M_1$ is the carbon content in the titanium extraction slag, %; $M_2$ is the carbon content in the carbon extraction and dechlorination tailing, %.

The formula (2) is:

$$\varepsilon=(m_1-m_2-m_3)/m_1\times 100\%$$

Wherein, ε is the removal rate of chlorine in the titanium extraction slag, %, $m_1$ is the water-soluble chlorine content in the titanium extraction slag, %, $m_2$ is the water-soluble chlorine content in the refined carbon, %, $m_3$ is the water-soluble chlorine content in the carbon extraction and dechlorination tailing.

An exemplary embodiment according to another aspect of the present disclosure provides an environmentally friendly carbonaceous additive for casting green sand. The environmentally friendly carbonaceous additive is mainly composed of a mixture of three raw materials, and specifically, the main raw materials are microcrystalline graphite, an extract of the titanium extraction slag (i.e. the titanium extraction slag extract) and a coal gasification slag. Wherein, in terms of mass percentage, the microcrystalline graphite accounts for 60-80%, the titanium extraction slag extract accounts for 0-20%, the coal gasification slag accounts for 0-20%, and the sum of the components is 100%. For example, in terms of mass percentage, the microcrystalline graphite accounts for 61% to 79%, the titanium extraction slag extract accounts for 1 to 19%, and the coal gasification slag accounts for 1 to 19%. For example, in terms of mass percentage, the microcrystalline graphite accounts for 65% to 75%, the titanium extraction slag extract accounts for 5 to 15%, and the coal gasification slag accounts for 5 to 15%.

Wherein, the microcrystalline graphite is a dense aggregate composed of tiny natural graphite crystals, which can have advantages of high carbon content (for example, the carbon content can be as high as 83%), good lubricity, stable physical and chemical properties at high temperatures, and low sulfur content, etc. In the casting process of the microcrystalline graphite, only a small amount of reducing gas is generated after high temperature heating, so it emits less polluting gas and has little harm to the environment. In addition, because the microcrystalline graphite has a good self-lubricating effect, it can improve the compact fluidity of the casting green sand and improve the molding performance of the casting green sand, so it can be used as an ideal coal powder substitute material.

Titanium extraction slag is a kind of secondary blast furnace slag obtained from titanium-containing blast furnace slag after undergoing the process of 'high temperature carbonization and low temperature selective chlorination' to extract titanium. It can contain a certain proportion (for example, the mass percentage is 5-8%) of carbon. For example, after the titanium extraction slag is processed by the flotation process, the titanium extraction slag extract can be obtained. The mass percentage of fixed carbon in the titanium extraction slag extract can reach 40-60%. The carbon contained in the titanium extraction slag extract is mainly graphite-like carbon (with a certain degree of graphitization, such as 41.51%), and has a low thermal expansion rate, so it can be used as a material for replacing coal powder in casting green sand. In this embodiment, in order to recycle the by-products of the carbon extraction and dechlorination process, the titanium extraction slag extract may be the refined carbon.

The coal gasification slag is a by-product of the coal gasification process. It is mainly composed of an amorphous glass phase and a small amount of crystalline minerals. The content of the crystalline phase can reach more than 67%. Due to the complexity of the raw coal types and the difference in the coal gasification process, the composition of the coal gasification slag is more complex, but the by-product contains 5-20% by mass of graphite-like phase carbon (with a higher degree of graphitization, such as 50.58%). At the same time, due to the complexity of its composition, it has low thermal expansion rate.

In this embodiment, the fixed carbon mass percentage of the microcrystalline graphite may be 78-83%, for example 79-82%; the fixed carbon mass percentage of the coal gasification slag may be 6-15%, for example 7-14%; the fixed carbon mass percentage of the titanium slag extract may be 45-55%, for example 46-54%.

In this embodiment, the graphite phase carbon of the microcrystalline graphite in the raw material is the main crystalline phase, and the mass percentage can be 98-100%, for example, 98.1-99.9%. The phases contained in the titanium extraction slag extract and the coal gasification slag including the crystalline phase and the amorphous phase. The mass percentage of the crystalline phase of the titanium extraction slag and the coal gasification slag may be 75-85% (for example 76-84%) and 15-25%(for example 16-24%), respectively.

In this embodiment, the microcrystalline graphite contains graphite phase carbon, and the graphitization degree thereof may be 93-98%, for example, 93.5-97.5%; the titanium extraction slag extract contains graphite-like phase carbon, and the graphitization-like degree thereof may be 38-53%, for example, 39-52%; the coal gasification slag contains graphite-like phase carbon, and the graphitization-like degree thereof may be 47-52%, for example, 47.5-1.5%.

In this embodiment, the environmentally friendly carbonaceous additive has the highest graphite phase content, followed by graphite-like carbon. Therefore, the environmentally friendly carbonaceous additive has a fixed carbon mass percentage as high as 65-83%, for example, 66-82%, for another example, 70-78%, can effectively prevent the surface of the casting from sticking to sand and reduce the surface roughness of the casting.

Wherein, the mineral phase in the environmentally friendly carbonaceous additive for casting green sand includes a crystalline phase and an amorphous phase. The mass percentage content of the crystalline phase may be 85-92%, for example, 86-91%, and the mass percentage content of the amorphous phase may be 8-15%, for example, 9%-4%, wherein the main crystalline phase is graphite phase carbon, and the secondary crystalline phase includes graphite-like phase carbon, anorthite, muscovite and quartz.

The environmentally friendly carbonaceous additive only vaporizes to produce a small amount of benzene and substituted benzene and a small amount of PAHs at a high temperature of 1000° C. Compared with pulverized coal, it does not produce harmful gases such as acenaphthylene, fluorene, anthracene and phenols, and the total amount of gas produced is less than one-tenth of that of pulverized coal.

The environmentally friendly carbonaceous additive can effectively improve the bonding performance between bentonite and quartz sand, and the green compressive strength of the casting green sand can be as high as 130-140 kPa (the pulverized coal sand is only 126.95 kPa), thereby significantly improving the process performance of the casting green sand.

Due to the complexity of the environmentally friendly carbon additives, the thermal expansion rate of the casting green sand can be effectively reduced. The thermal expansion rate in the temperature range of 0 to 1200° C. is less than 1.5%, which can effectively prevent the deformation of the casting.

The environmentally friendly carbonaceous additive for casting green sand of the present disclosure may also include flake graphite, fly ash, 'carbon' in fly ash and other carbon-rich materials in addition to the microcrystalline graphite, the 'carbon' in the titanium extraction slag and the coal gasification slag adopted in the embodiments of the present disclosure. The main component of the flake graphite is graphite, which is the same as the microcrystalline graphite, having the advantages of high carbon content, good lubricity and stable physical and chemical properties under high temperature conditions. It can act as bright carbon while reducing pollution and improve the quality of castings. The fly ash contains 5-20% of unburned carbon, and due to the complexity of the composition, the overall thermal expansion rate of the casting green sand can be reduced. In addition, the 'carbon' in fly ash is also graphite-like phase carbon. Extracting the 'carbon' in fly ash can obtain a 'carbon-containing' material with a fixed carbon content of more than 50%, which is used as the carbon additive in casting green sand, and can also act as bright carbon to smooth the surface of castings.

An exemplary embodiment according to another aspect of the present disclosure provides a method for preparing an environmentally friendly carbonaceous additive for casting green sand as described above. The microcrystalline graphite, the extract of the titanium extraction slag and the coal gasification slag are used as main raw materials, and mixed to obtain an environmentally friendly carbonaceous additive for casting green sand, the extract of the titanium extraction slag is the refined carbon.

In an embodiment, the method may comprise: the raw materials of the microcrystalline graphite, the titanium extraction slag extract and the coal gasification slag are ground and passed through a 200-mesh sieve, and the mass ratio thereof is 60~80:0~20:0~20, for example, (61~79): (1~19): (1~19), and for another example (70~75): (5-15): (5-15). The ground raw materials are weight and placed into a mixer, stirred and mixed evenly, to obtain the environmentally friendly carbonaceous additive for casting green sand.

An exemplary embodiment according to another aspect of the present disclosure provides casting green sand, the casting green sand comprises 100 parts by mass of quartz sand, 8-10 parts by mass of sodium bentonite, and 3-7 parts by mass of the environmentally friendly carbonaceous additives. That is, the mass percentages of sodium bentonite and environmentally friendly carbonaceous additive may be converted to 100 parts of quartz sand, which are 8-10% and 3-7%, respectively. Wherein, the environmentally friendly carbonaceous additive is the environmentally friendly carbonaceous additive for casting green sand as described above, and the quartz sand is 70-140 mesh.

An exemplary embodiment according to another aspect of the present disclosure provides a method for preparing the casting green sand sample. The preparation method includes: 100 parts by mass of the quartz sand, 8-10 parts by mass of the sodium bentonite, and 3~7 parts by mass of the environmentally friendly carbonaceous additive are sent into the sand mixer for sand mixing, and 50 mm±1% cylindrical samples and 30 mm±1% strip samples that are used for testing properties of the green compressive strength and thermal expansion rate are made by hammering type sample preparation machine. Wherein, the sample compaction rate is controlled to 45±2%, and the environmentally friendly carbonaceous additive is the environmentally friendly carbonaceous additive for casting green sand as described above.

The exemplary embodiments of the present disclosure will be further described and set forth below in conjunction with specific examples.

EXAMPLE 1

The specific method is as follows:

1) The titanium extraction slag with a chlorine content of 5% and a moisture content of 5.3% was dried at 150° C. for 120 minutes, so as to reduce the moisture content thereof to 1%; and then, the titanium extraction slag with a moisture content of 1% was placed in a ball mill. The mass ratio of the ball and the titanium extraction slag is 1:1 kg/kg, the rotating speed of the ball mill is 180 r/min, and by ball milling for 90 min to obtain the treated material with $d_{90} \leq 90$ μm.

2) the treated material is placed into the mixer, and the water is added therein to adjust the liquid-solid ratio to 4:1 L/kg, and then 2.0 kg/t titanium extraction slag of kerosene is added, mixed and stirred evenly, and transferred to the flotation machine for the primary flotation. The agitator and air pump of the flotation machine are turned on; the stirring rate is set to 1500 r/min; the aeration rate is controlled to 0.35 $m^3$/min; then 1.5 kg/t titanium extraction slag of No. 2 oil is added, and the floatation is carried out for 3 min. During the flotation process, the scraper is turned on to sweep the floating product into the recovery tank. After the flotation is completed, the sinking product is filtered, dried and dehydrated to form the carbon extraction and dechlorination tailing. The first filtrate produced during the filtration of the sinking product is returned to the mixer to reuse.

3) The floated product in the recovery tank is transport to the mix slurry machine; the water is added therein to adjust the liquid-solid ratio to 4:1 L/ kg, and then 1 kg/t titanium extraction slag of kerosene is added, mixed evenly and transferred to the flotation machine for the secondary flotation. The agitator and air pump of the flotation machine are turned on; the stirring rate is controlled at 1500 r/min, the aeration rate is controlled at 0.35 $m^3$/min, and then 0.75 kg/t titanium extraction slag of No. 2 oil f is added, and the floatation is carried out for 6 min. During the flotation process, the scraper is turned on to sweep the floating product that floats to the liquid surface. After filtration, drying and dehydration, refined carbon containing the graphite-like carbon is obtained. After flotation, the product that sinks in the bottom tank is filtered, dried and dehydrated, and can be used as the treated material re-processing for carbon extraction; and the second filtrate produced in the filtration process of the bottom tank product is returned to the mix slurry machine for reuse.

After testing, the ignition loss of the obtained refined carbon is 49.6% and the chlorine content is 0.03%; the ignition loss of the obtained carbon extraction and dechlorination tailing is 0.43% and the chlorine content thereof is 0.05%; the dechlorination efficiency of the titanium extraction slag is 98.5%.

As shown in FIG. 3, the phase of the refined carbon obtained in this example is the same as that of the raw material, the graphite-like carbon is the main crystalline phase, and the crystallinity is 80%. As shown in FIG. 4, the phases of the carbon extraction and dechlorination tailing obtained in this example include a crystalline phase and an amorphous phase, wherein the crystalline phase is only titanium carbide, with a crystallinity of 10%. Comparing FIG. 3 with FIG. 4, it can be seen that the graphite-like carbon can be enriched in the refined carbon by flotation, and this method can efficiently recover the graphite-like carbon in the titanium extraction slag.

EXAMPLE 2

The specific method is as follows:

1) The raw material of titanium extraction slag with a chlorine content of 2.5% and a moisture content of 2% was dried at 150° C. for 60 minutes, so as to reduce the moisture content thereof to 0.5%; t and then, the titanium extraction slag with a moisture content of 0.5% was placed in a ball mill. The mass ratio of the ball and the titanium extraction slag is 2:1 kg/ kg, the rotating speed of the ball mill is 220 r/min, and by ball milling for 60 min to obtain the treated material with $d_{90} \leq 90$ μm.

2) the treated material is placed into the mixer, and the water is added therein to adjust the liquid-solid ratio to 3.5:1 L/ kg, and then 0.5 kg/t titanium extraction slag of kerosene is added, mixed and stirred evenly, and transferred to the flotation machine for the primary flotation. The agitator and air pump of the flotation machine are turned on; the stirring rate is set to 1300 r/min, the aeration rate is controlled to 0.3 $m^3$/min; and then 2.5 kg/t titanium extraction slag of No. 2 oil is added, followed by flotation for 2 minutes; During the flotation process, the scraper is turned on to sweep the floating product into the recovery tank. After the flotation is completed, the sinking product is filtered, dried and dehydrated to form the carbon extraction and dechlorination tailing. The first filtrate produced during the filtration of the sinking product is returned to the mixer to reuse.

3) The floated product in the recovery tank is transport to the mix slurry machine; the water is added therein to adjust the liquid-solid ratio to 5:1 L/ kg, then 0.5 kg/t titanium extraction slag of kerosene is added, mixed evenly and transferred to the flotation machine for the secondary flotation. The agitator and air pump of the flotation machine are turned on; the stirring rate is controlled at 1500 r/min, the aeration rate is controlled at 0.35 $m^3$/min, and then 0.5 kg/t titanium extraction slag of No. 2 oil is added, and the floatation is carried out for 6 min. During the flotation process, the scraper is turned on to sweep the floating product that floats to the liquid surface. After filtration, drying and dehydration, refined carbon containing the graphite-like carbon is obtained. After flotation, the product that sinks in the bottom tank is filtered, dried and dehydrated, and used as the treated material re-processing for carbon extraction; and the second filtrate produced in the filtration process of the bottom tank product is returned to the mix slurry machine for reuse.

After testing, the ignition loss of the obtained refined carbon is 46%, and the chlorine content is 0.02%; the ignition loss of the obtained carbon extraction and dechlorination tailing is 2.5%, and the chlorine content thereof is 0.04%; the dechlorination efficiency of the titanium extraction slag is 97.6%. Both of the obtained refined carbon and the carbon extraction and dechlorination tailing include crystalline and amorphous phases. Wherein, the crystalline phase of the refined carbon is graphite-like carbon, titanium carbide, rutile and hematite, with a crystallinity of 75%; the crystalline phase of the carbon extraction and dechlorination tailing is only titanium carbide, with a crystallinity of 12%.

EXAMPLE 3

The specific method is as follows:

1) The titanium extraction slag with a chlorine content of 5.5% and a moisture content of 7% was dried at 250° C. for 120 minutes to reduce its moisture content to 0.5%; and then, the titanium extraction slag with a moisture content of 0.5% was placed in a ball mill. The mass ratio of the ball and the titanium extraction slag is 2:1 kg/kg, the rotation speed is 220 r/min, and by ball milling for 60 min to obtain the treated material with $d_{90} \leq 90$ μm.

2) the treated material is placed into the mixer, and the water is added therein to adjust the liquid-solid ratio to 4.5:1, then 2.5 kg/t titanium extraction slag of kerosene is added, mixed and stirred evenly, and transferred to the flotation machine for the primary flotation. The agitator and air pump of the flotation machine are turned on; the stirring rate is set to 1500 r/min; the aeration rate is controlled to 0.33 $m^3$/min; then 1.5 kg/t titanium extraction slag of No. 2 oil is added, and then the flotation process is carried out for 4 min. During the flotation process, the scraper is turned on to sweep the floating product into the recovery tank. After the flotation is completed, the sinking product is filtered, dried and dehydrated to form a carbon extraction and dechlorination tailing. The first filtrate produced during the filtration of the sinking product is returned to the mixer to reuse.

3) The floated product in the recovery tank is transport to the mix slurry machine; the water is added therein to adjust the liquid-solid ratio to 4:1 L/ kg, and then add 0.5 kg/t titanium extraction slag of kerosene is added, mixed evenly and transferred to the flotation machine for the secondary flotation. The agitator and air pump of the flotation machine are turned on; the stirring rate is controlled at 1800 r/min, the aeration rate is controlled at 0.35 $m^3$/min, and then 1 kg/t titanium extraction slag of No. 2 oil is added, and the floatation is carried out for 9 min. During the flotation process, the scraper is turned on to sweep the floating product that floats to the liquid surface. After filtration, drying and dehydration, refined carbon containing the graphite-like carbon is obtained. After flotation, the product that sinks in the bottom tank is filtered, dried and dehydrated, and used as the treated material re-processing for carbon extraction; and the second filtrate produced in the filtration process of the bottom tank product is returned to the mix slurry machine for reuse.

After testing, the ignition loss of the obtained refined carbon is 60%, and the chlorine content is 0.03%; the ignition loss of the obtained carbon extraction and dechlorination tailing is 1.07%, and the chlorine content thereof is 0.06%; the dechlorination efficiency of the titanium extraction slag is 98.4%. Both the obtained refined carbon and the carbon extraction and dechlorination tailing include crystalline and amorphous phases. Wherein, the crystalline phase of the refined carbon is graphite-like carbon, titanium carbide, rutile and hematite, with a crystallinity of 85%; the crystalline phase of the carbon extraction and dechlorination tailing is only titanium carbide, with a crystallinity of 10.5%.

Another aspect of the present disclosure provides a carbon extraction and dechlorination tailing.

In another exemplary embodiment of the present disclosure, the carbon extraction and dechlorination tailing is obtained by the carbon extraction and dechlorination method of titanium extraction slag in the above exemplary embodiment, and the carbon extraction and dechlorination tailing includes 30~32% CaO, 27~28% $SiO_2$, 13~15% $Al_2O_3$, 12~14% $TiO_2$, 7~8% MgO, 2~2.5% $Fe_2O_3$, 0.34~2.1% C, 0.04~0.06% Cl by mass fraction.

In this embodiment, the loss on ignition of the carbon extraction and dechlorination tailing may be 0.4~2.5%, the crystalline phase thereof may be titanium carbide, and the crystallinity thereof may be 10~12%. Specifically, the crystalline phase of the carbon extraction and dechlorination tailing after the treatment of carbon extraction and dechlorination is only titanium carbide. The crystallinity of the sample of the carbon extraction and dechlorination tailing is calculated by Jade, and the crystallinity of the carbon extraction and dechlorination tailing is 10~12%.

In order to better understand the above exemplary embodiments of the present disclosure, specific examples are given below in conjunction with the environmentally friendly carbon additive prepared from the microcrystalline graphite, the titanium extraction slag extract and the coal gasification slag as raw materials.

EXAMPLE 4

The microcrystalline graphite, the 'carbon' in the titanium extraction slag and the coal gasification slag are pretreated to obtain powders of the microcrystalline graphite, the titanium extraction slag extract and the coal gasification slag with 200 mesh (particle size <75 μm), respectively; The powder is weighed at a mass ratio of 80:0:20 and placed in a mixer to stir and mix uniformly to obtain the environmentally friendly carbonaceous additive for casting green sand.

The mass parts of quartz sand (70/140 mesh) is 100, the mass parts of sodium bentonite is 8, and the mass parts of the environmentally friendly carbonaceous additive for casting green sand is 5, and the weighed materials are put into the roller-type sand mixer for sand mixing, and the sample compaction rate is controlled to 45±2%. The hammer type sample preparation machine is used to make 50 mm±1% cylindrical sample and 30 mm±1% strip sample, and the related performance thereof is test.

The content of the mineral crystalline phase in the prepared environmentally friendly carbonaceous additive for casting green sand accounts for 83.63% by mass. Wherein, the main crystalline phase is graphite phase carbon, and the secondary crystalline phases are graphite-like phase carbon, anorthite, muscovite and quartz. The graphitization degrees of graphite phase carbon and graphite-like phase carbon in the main crystalline phase are 95.12% and 50.58%, respectively. The physical and chemical properties of the carbonaceous additive were tested. The fixed carbon mass percentage thereof was 66.52%. The green compressive strength of the cylindrical sand samples mixed and prepared by the environmentally friendly carbonaceous additive was 133.93 kPa, and the thermal expansion rate of the strip sample was 1.33% at 1200° C.

EXAMPLE 5

The microcrystalline graphite, titanium extraction slag extract and coal gasification slag are pretreated to obtain powders of the microcrystalline graphite, the titanium extraction slag extract and the coal gasification slag with 200 mesh (particle size <75 μm), respectively; The powder is weighed at a mass ratio of 80:10:10 and placed in a mixer to stir and mix uniformly to obtain the environmentally friendly carbonaceous additive for casting green sand.

The mass parts of quartz sand (70/140 mesh) is 100, the mass parts of sodium bentonite is 10, and the mass parts of the environmentally friendly carbonaceous additive for casting green sand is 5, and the weighed materials are put into the roller-type sand mixer for sand mixing, and the sample compaction rate is controlled to 45±2%. The hammer type sample maker is used to make 50 mm±1% cylindrical samples and 30 mm±1% strips samples, and the related performance thereof is test.

The content of the mineral crystalline phase in the prepared environmentally friendly carbonaceous additive for casting green sand accounts for 89.81% by mass. Wherein, the main crystalline phase is graphite phase carbon, and the secondary crystalline phases are graphite-like phase carbon, anorthite, muscovite and quartz. The graphitization degrees of graphite phase carbon and graphite-like phase carbon in the main crystalline phase are 95.12% and 46.05% respectively. The physical and chemical properties of the carbonaceous additive were tested, and the fixed carbon mass percentage was 71.23%. The green compressive strength of the cylindrical sand samples mixed and prepared by the environmentally friendly carbonaceous additive was 136.34 kPa, and the thermal expansion rate of the strip sample was 1.31% at 1200° C.

EXAMPLE 6

The microcrystalline graphite, titanium extraction slag extract and coal gasification slag are pretreated to obtain powders of the microcrystalline graphite, the titanium extraction slag extract and the coal gasification slag with 200 mesh (particle size <75 μm), respectively; The powder is weighed at a mass ratio of 80:20:0 and placed in a mixer to stir and mix evenly to obtain the environmentally friendly carbonaceous additive for casting green sand.

The mass parts of quartz sand (70/140 mesh) is 100, the mass parts of sodium bentonite is 8, and the mass parts of the environmentally friendly carbonaceous additive for casting green sand is 5, and the weighed materials are put into the roller-type sand mixer for sand mixing, and the sample compaction rate is controlled to 45±2%. The hammer type sample preparation machine is used to make 50 mm±1% cylindrical sample and 30 mm±1% strip sample, and the related performance thereof is test.

The mass percentage of the mineral crystalline phase of the prepared environmentally friendly carbonaceous additive for casting green sand accounts for 95.99%. Wherein, the main crystalline phase is graphite phase carbon, and the secondary crystalline phases are graphite-like phase carbon, anorthite, muscovite and quartz. The graphitization degrees of graphite phase carbon and graphite-like phase carbon in the main crystalline phase are 95.12% and 41.51% respectively. The physical and chemical properties of the carbonaceous additive were tested. The fixed carbon mass percentage thereof was 75.43%. The green compressive strength of the cylindrical sand samples mixed and prepared by the environmentally friendly carbonaceous additive was 136.88 kPa, and the thermal expansion rate of the strip sample was 1.28% at 1200° C.

Figure 5:
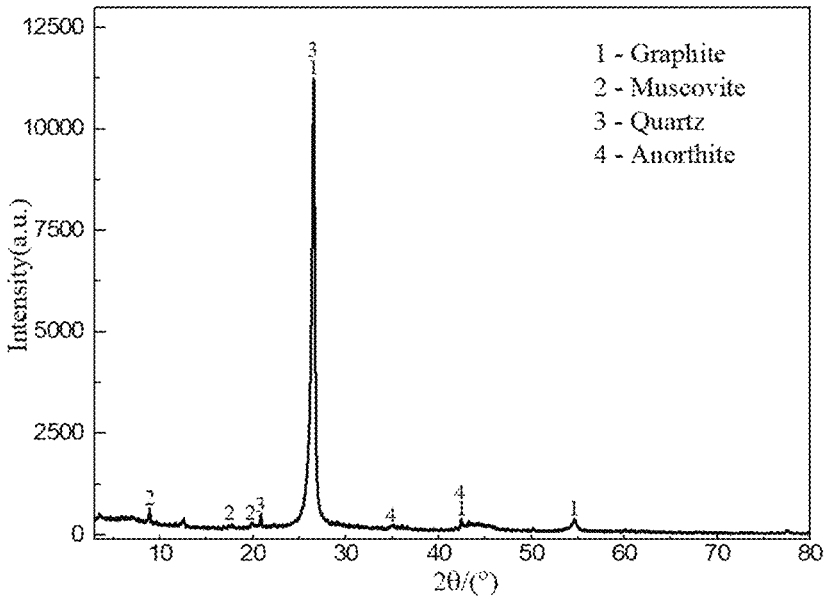
FIG. 5 is an X-ray diffraction diagram of the environmentally friendly carbonaceous additive for casting green sand of the present disclosure.
Figure 6:
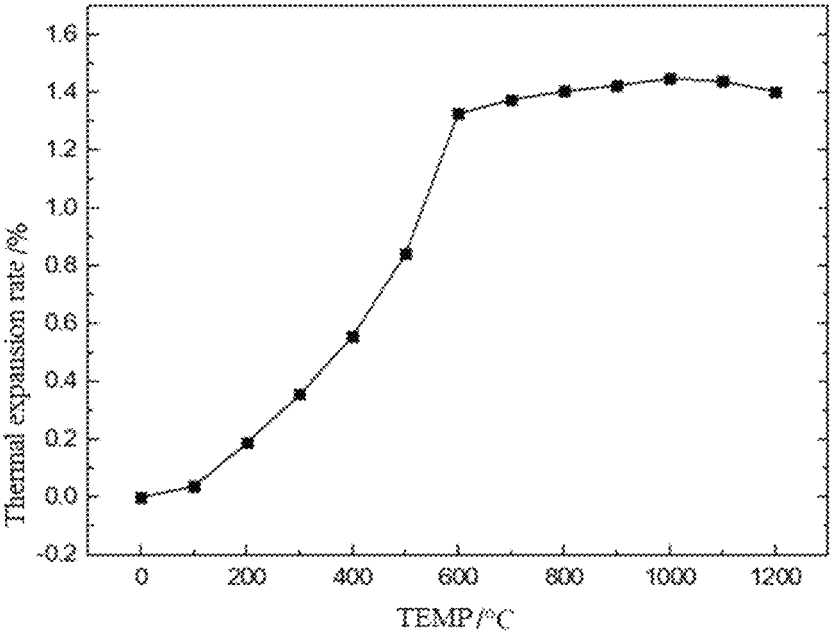
FIG. 6 is a graph showing the variation of thermal expansion rate with temperature of the environmentally friendly carbonaceous additive for casting green sand of the present disclosure.
Figure 7:
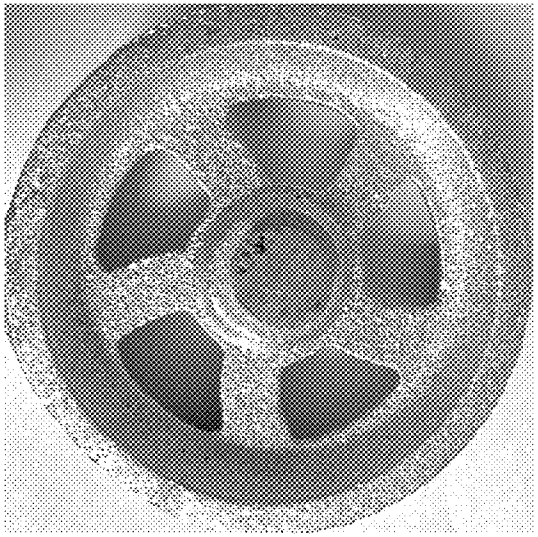
FIG. 7 is an effect diagram of the disclosed environmentally friendly carbonaceous additive for casting green sand used in casting aluminum castings.

FIGS. 5 to 7 show the X-ray diffraction pattern of the environmentally friendly carbonaceous additive for casting green sand in Example 6, the graph of the thermal expansion rate with temperature, and the effect graph of its use in casting aluminum castings. It can be seen from FIG. 7 that when the environmentally friendly carbon additive is used for casting aluminum castings, the surface of the castings is smooth without casting defects.

EXAMPLE 7

The microcrystalline graphite, titanium extraction slag extract and coal gasification slag are pretreated to obtain powders of the microcrystalline graphite, the titanium extraction slag extract and the coal gasification slag with 200 mesh (particle size <75 μm), respectively; The powder is weighed at a mass ratio of 80:15:5 and placed in a mixer to stir and mix uniformly to obtain the environmentally friendly carbonaceous additive for casting green sand.

The mass parts of quartz sand (70/140 mesh) is 100, the mass parts of sodium bentonite is 9, and the mass parts of the environmentally friendly carbonaceous additive for casting green sand is 7, and the weighed materials are put into the roller-type sand mixer for sand mixing, and the sample compaction rate is controlled to 45±2%. The hammer type sample preparation machine is used to make 50 mm±1% cylindrical sample and 30 mm±1% strip sample, and the related performance thereof is test.

The content of the mineral crystalline phase in the prepared environmentally friendly carbonaceous additive for casting green sand accounts for 92.90% by mass. Wherein, the main crystalline phase is graphite phase carbon, and the subsidiary crystalline phases are graphite-like phase carbon, anorthite, muscovite and quartz. The graphitization degrees of graphite and graphite-like phase carbon in the main crystalline phase are 95.12% and 43.78%, respectively. The physical and chemical properties of the carbonaceous additive were tested. The fixed carbon mass percentage thereof was 74.97%. The green compressive strength of the cylindrical sand samples mixed and prepared by the environmentally friendly carbonaceous additive was 132.65 kPa, and the thermal expansion rate of the strip sample was 1.37% at 1200° C.

EXAMPLE 8

The microcrystalline graphite, titanium extraction slag extract and coal gasification slag are pretreated to obtain powders of the microcrystalline graphite, the titanium extraction slag extract and the coal gasification slag with 200 mesh (particle size <75 μm), respectively; The powder is weighed at a mass ratio of 80:5:15 and placed in a mixer to stir and mix uniformly to obtain the environmentally friendly carbonaceous additive for casting green sand.

The mass parts of quartz sand (70/140 mesh) is 100, the mass parts of sodium bentonite is 8, and the mass parts of the environmentally friendly carbonaceous additive for casting green sand is 3, and the weighed materials are put into the roller-type sand mixer for sand mixing, and the sample compaction rate is controlled to 45±2%. The hammer type sample preparation machine is used to make 50 mm±1% cylindrical sample and 30 mm±1% strip sample, and the related performance thereof is test.

The content of the mineral crystal phase in the prepared environmentally friendly carbonaceous additive for casting green sand accounts for 86.72% by mass. Wherein, the main crystalline phase is graphite phase carbon, the secondary crystalline phase is graphite-like phase carbon, anorthite, muscovite and quartz, and the graphitization degrees of graphite phase carbon and graphite-like phase carbon in the main crystalline phase are 95.12% and 48.31% respectively. The physical and chemical properties of the carbonaceous additive were tested, and the fixed carbon mass percentage thereof was 68.34%. The green compressive strength of the cylindrical sand samples mixed and prepared by the environmentally friendly carbonaceous additive was 138.71 kPa, and the thermal expansion rate of the strip sample was 1.30% at 1200° C.

In summary, the advantages of the method for carbon extraction and dechlorination of titanium extraction slag and the carbon extraction and dechlorination tailing prepared by the method of the present disclosure may include:

(1) Effectively recover the graphite-like carbon in the titanium extraction slag to avoid waste of carbon resources;

(2) Efficiently remove chlorine from the titanium extraction slag, with a dechlorination efficiency of 97~98.5%;

(3) The ignition loss of the carbon extraction and dechlorination tailing is 0.4~2.5%, and the chlorine content is 0.04~0.06%. The ignition loss and chlorine content of the carbon extraction and dechlorination tailing meet the requirements of relevant standards for building materials and can be used as building materials;

(4) The refined carbon contained the graphite-like carbon has an ignition loss of 46~60% and a chlorine content of 0.02~0.03%, and can be used as an industrial fuel.

In addition, the environmentally friendly carbonaceous additive for casting green sand prepared by the present disclosure using microcrystalline graphite, titanium extraction slag extract and coal gasification slag has a significant improvement over the existing carbonaceous additive products, and its beneficial effects are as follows:

(1) The present disclosure uses the microcrystalline graphite, the titanium extraction slag extract and the coal gasification slag as raw materials to prepare carbonaceous additives, and provides a new utilization method for the titanium extraction slag and coal gasification slag industrial solid waste.

(2) By comparing the gas composition and output of the environmentally friendly carbonaceous additive for casting green sand and the pulverized coal additive at 1000° C., Compared with pulverized coal, the types of gases produced by carbonaceous additives are less harmful gases such as acenaphthylene, fluorene, anthracene and phenols, etc; and the total amount of gas produced is only about 10% of pulverized coal, indicating that the prepared carbonaceous additives are more friendly to humans and the environment.

(3) When the carbonaceous additive of the present disclosure is used for casting green sand, its green compressive strength can reach up to 138.71 kPa (the green compressive strength of pulverized coal sand is only 126.95 kPa), indicating that the carbonaceous additive can improve the strength of the casting green sand.

(4) When the carbonaceous additive of the present disclosure is used for casting green sand, the minimum thermal expansion rate at 1200° C. is only 1.28%, indicating that the prepared carbonaceous additive can effectively prevent deformation of castings during high-temperature casting.

Although the present disclosure has been described above in conjunction with exemplary embodiments, it should be clear to those skilled in the art that various modifications and changes can be made to the exemplary embodiments of the present disclosure without departing from the spirit and scope defined by the claims change.

What is claimed is:

1. A method for processing titanium extraction slag, wherein the method comprising a carbon extraction and dechlorination process, wherein the carbon extraction and dechlorination process comprising following steps:

grinding the titanium extraction slag raw material to obtain a treated material with a particle size of 0.3~120μm and d90≤90 μm;

mixing a first solvent and the treated material with a liquid-to-solid ratio of 3.5~4.5:1 L/kg, additionally adding a first capturing agent and a first foaming agent to mix, and then performing a primary flotation to obtain a floating product and a sinking product;

filtering the sinking product to obtain a first filtrate, returning the first filtrate to be used as the first solvent, after multiple cycles of the first filtrate evaporation, concentration and crystallization, to obtain a chloride powder;

adding a second solvent to the floating product to adjust the liquid-to-solid ratio to 4~5:1 L/kg, additionally adding a second capturing agent and a second foaming agent to mix, and then performing a secondary flotation to obtain a foam product and a bottom tank product;

filtering and drying the bottom tank product to obtain a filter residue and a second filtrate, and returning the second filtrate to be used as the second solvent after multiple cycles of the second filtrate evaporation, concentration and crystallization, to obtain the chloride powder;

filtering and drying the foamed product to obtain a refined carbon, and filtering and drying the sinking product to obtain a carbon extraction and dechlorination tailing;

wherein, the d90≤90 μm means that more than 90% of the powder in the treated material has a particle size of less than or equal to 90 μm;

the titanium extraction slag is a secondary industrial waste slag obtained from titanium-containing blast furnace slag after undergoing a process of high-temperature carbonization and low-temperature selective chlorination to extract titanium, the titanium extraction slag contains 5~10% carbon and 2~5% chlorine;

the carbon extraction and dechlorination tailing includes 30~32% CaO, 27~28% $SiO_2$, 13~15% $Al_2O_3$, 12~14% $TiO_2$, 7~8% MgO, 2~2.5% $Fe_2O_3$, 0.34~2.1% C, 0.04~0.06% Cl by mass fraction;

the ignition loss of the carbon extraction and dechlorination tailing is 0.4~2.5%, the crystalline phase is titanium carbide, and the crystallinity is 10~12%;

the carbon extraction and dechlorination tailing can be directly used as building materials;

the refined carbon is graphite-like carbon, the ignition loss thereof is 46~60%, and the chlorine content thereof is 0.02~0.03%;

a removal rate of carbon in the titanium extraction slag is 50~90%, and a removal rate of chlorine is 97~98.5%; and both of the primary flotation and the secondary flotation are realized by a flotation machine, and wherein during the primary flotation, the stirring rate of the flotation machine is 1300~1500 r/min, the aeration amount is 0.3~0.35 $m^3$/min, and the flotation time is 2~4 min; during the secondary flotation, the stirring rate of the flotation machine is 1500 to 1800 r/min, an aeration amount is 0.3 to 0.35 $m^3$/min, and a flotation time is 6 to 9 min; the amount of the first capturing agent is 0.5~2.5 kg/t titanium extraction slag, the amount of the first foaming agent is 0.5~2.5 kg/t titanium extraction slag, the amount of the second capturing agent is 0.5~1.0 kg/t titanium extraction slag, and the amount of the second foaming agent is 0.5~1.0 kg/t titanium extraction slag.

2. The method for processing the titanium extraction slag according to claim 1, wherein the method further comprises a step of returning the filter residue to be used as the treated material.

3. The method for processing the titanium extraction slag according to claim 1, wherein the first capturing agent and the second capturing agent both include at least one of kerosene and diesel, and the first foaming agent and the second foaming agent both include at least one of second oil and secondary octanol.

4. The method for processing the titanium extraction slag according to claim 1, wherein the method further comprises:

using a microcrystalline graphite, an extract of the titanium extraction slag and coal gasification slag as main raw materials, mixing to obtain an environmentally friendly carbonaceous additive for casting green sand, the extract of the titanium extraction slag is the refined carbon.

5. The method for processing the titanium extraction slag according to claim 4, wherein the method comprises:

grinding the raw materials contained the microcrystalline graphite, the extract of the titanium extraction slag and the coal gasification slag to obtain a powder with a particle size of <75 μm;

uniformly mixing the microcrystalline graphite, the extract of the titanium extraction slag and the coal gasification slag powder in a mass ratio of 60-80:0-20:0-20 to obtain the environmentally friendly carbonaceous additive.

6. The method for processing the titanium extraction slag according to claim 4, wherein the fixed carbon content of the environmentally friendly carbonaceous additive is 65-83% by mass, and the fixed carbon of the microcrystalline graphite is 78-83% by mass, the fixed carbon of the titanium extraction slag extract is 45-55% by mass, and the fixed carbon of the coal gasification slag is 6-15% by mass.

7. The method for processing the titanium extraction slag according to claim 4, wherein the graphite phase carbon content of the microcrystalline graphite is 98-100% by mass; both of the extract of the titanium extraction slag and the coal gasification slag include a crystalline phase and an amorphous phase, the crystalline phase in the extract of titanium extraction slag is 75-85% by mass, and the crystalline phase in the coal gasification slag is 15~25% by mass.

8. The method for processing the titanium extraction slag according to claim 4, wherein a mineral phase in the environmentally friendly carbonaceous additive includes a crystalline phase and an amorphous phase, and the mass percentage content of the crystalline phase is 85-92%, the mass percentage content of the amorphous phase is 8-15%, wherein the main crystalline phase is graphite phase carbon, and the secondary crystalline phase includes graphite-like phase carbon.

9. The method for processing the titanium extraction slag according to claim 4, wherein the microcrystalline graphite contains graphite phase carbon with a graphitization degree of 93-98%; and the extract of the titanium extraction slag contains graphite-like phase carbon with a graphitization-like degree of 38-53%; the coal gasification slag contains graphite-like phase carbon with a graphitization-like degree of is 47-52%.

10. The method for processing the titanium extraction slag according to claim 4, wherein the raw materials further includes one or more of flake graphite, fly ash, carbon in fly ash and other carbon-rich materials.

11. The method for processing the titanium extraction slag according to claim 4, wherein the method further comprises:

preparing green casting sand with 100 parts by mass of quartz sand, 8-10 parts by mass of sodium bentonite, and 3-7 parts by mass of the environmentally friendly carbonaceous additive.

12. The method for processing the titanium extraction slag according to claim 11, wherein the step of preparing green casting sand includes:

sending 100 parts by mass of quartz sand, 8-10 parts by mass of sodium bentonite, and 3-7 parts by mass of environmentally friendly carbonaceous additive into a sand mixer to mix, and using a sample preparation machine to make 50 mm±1% cylindrical samples and 30 mm±1% strip samples, wherein a sample compaction rate is controlled to 45±2%.

* * * * *